US008523340B2

(12) United States Patent
Sabo et al.

(10) Patent No.: US 8,523,340 B2
(45) Date of Patent: Sep. 3, 2013

(54) REDUCING INK DROPLETS GENERATED BY BURSTING BUBBLES IN AN INK DEVELOPER

(75) Inventors: David Sabo, San Diego, CA (US); Evgeny Korol, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 194 days.

(21) Appl. No.: 12/996,004

(22) PCT Filed: Jun. 5, 2008

(86) PCT No.: PCT/US2008/065872

§ 371 (c)(1),
(2), (4) Date: Dec. 2, 2010

(87) PCT Pub. No.: WO2009/148448

PCT Pub. Date: Dec. 10, 2009

(65) Prior Publication Data

US 2011/0074894 A1 Mar. 31, 2011

(51) Int. Cl.
*B41J 2/19* (2006.01)

(52) U.S. Cl.
USPC ..... 347/92; 347/12; 347/47; 347/54; 347/85; 347/86; 401/202

(58) Field of Classification Search
None
See application file for complete search history.

(56) References Cited

U.S. PATENT DOCUMENTS

| | | | | |
|---|---|---|---|---|
| 3,758,204 | A * | 9/1973 | Mochizuki | 399/245 |
| 4,155,329 | A | 5/1979 | Tsukamoto et al. | |
| 5,506,372 | A * | 4/1996 | Guth et al. | 399/254 |
| 7,356,287 | B2 | 4/2008 | Guzman et al. | |
| 7,766,462 | B2 * | 8/2010 | Haluzak et al. | 347/71 |
| 2005/0140750 | A1 * | 6/2005 | Ogawa et al. | 347/84 |
| 2007/0177906 | A1 * | 8/2007 | Yamanaka et al. | 399/279 |
| 2007/0231013 | A1 | 10/2007 | Hasdai et al. | |

FOREIGN PATENT DOCUMENTS

JP 2000221786 A 8/2000

* cited by examiner

*Primary Examiner* — Matthew Luu
*Assistant Examiner* — John P Zimmermann

(57) ABSTRACT

An apparatus for reducing ink droplets generated by bursting bubbles within an ink developer includes a surface directing an ink flow into a channel; and a protrusion within the channel that reduces ink droplets generated by bursting bubbles entrained within the ink flow. An ink developer includes an ink source supplying ink to the ink developer; an electrode which develops a portion of the ink onto a developer roller; and a splash guard which directs an undeveloped ink flow into a channel which has a reduced cross-section area configured to reduce bubbles exiting the channel and bursting.

14 Claims, 6 Drawing Sheets

REDUCING INK DROPLETS GENERATED BY BURSTING BUBBLES IN AN INK DEVELOPER

RELATED APPLICATIONS

The present application claims the priority under 35 U.S.C. 119(a)-(d) or (f) and under C.F.R. 1.55(a) of previous International Patent Application No.: PCT/US2008/065872, filed Jun. 5, 2008, entitled "Reducing Ink Droplets Generated by Bursting Bubbles in an Ink Developer", which application is incorporated herein by reference in its entirety.

BACKGROUND

In printing devices that utilize ink, air bubbles can become entrained in ink flows within the device. When these air bubbles burst, ink droplets are ejected. These ink droplets can create print quality defects and contribute to the accumulation of concentrated ink (or sludge) that can block or limit the flow of ink, which in turn can result in malfunctions and customer dissatisfaction.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Figure 1:
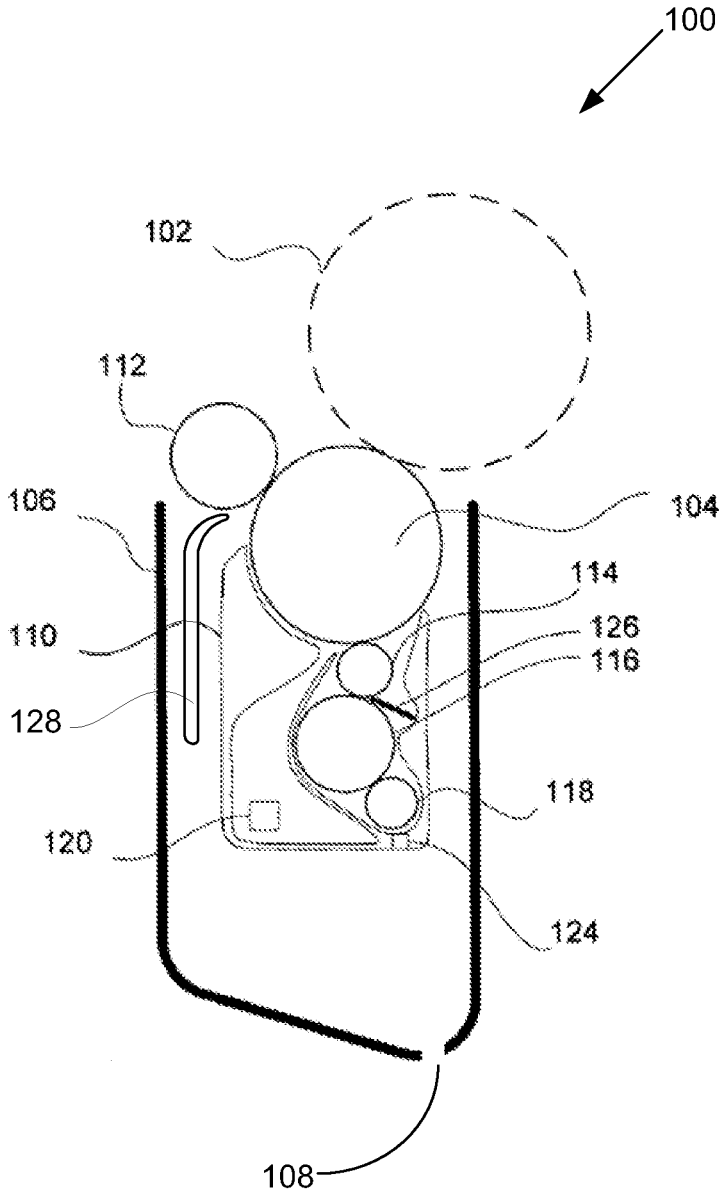
FIG. 1 shows one illustrative embodiment of an ink developer device, according to principles described herein.

FIG. 1 shows a side view of one exemplary embodiment of an ink developer device (100). The ink developer device (100) may be utilized in liquid electro photography (LEP) printers. Furthermore, the ink developer device (100) may be a binary ink developer (BID) unit.

One of the purposes of the ink developer device (100) is to present a uniform film of ink to a photo-conductive drum (102). To do this, the device (100) utilizes a continuous flow of ink that enters through the inlet port (120), travels through the device to where a small portion of the ink is transferred to the photo-conductive drum (102), with the majority of the ink exiting the device (100) through the ink outlet (108). This non-developed ink returns to an ink reservoir where it is reconditioned and re-circulated into the ink developer device (100) through the inlet port (120).

The ink includes a fluid carrier and ink particles. The ink particles are suspended in the fluid carrier, which allows the ink particles to be easily transported, stored, and manipulated. The ink particles are influenced by the presence of electromagnetic fields, while the fluid carrier is not.

The device (100) includes an ink developer roller (104) that is configured to supply a uniform film of ink that is then selectively transferred to the photoconductive drum (102). To selectively transfer the ink, a charge pattern that corresponds to the image being printed is generated on the photoconductive drum (102) by a laser. Ink on the outer surface of the developer roller (104) is transferred to the charged portions of the photoconductive drum (102). This creates a liquid ink pattern that is then transferred from the photoconductive drum (102) to a print medium such as paper or to an intermediate transfer member to form the desired image on the print medium.

The device (100) also includes an ink tray (106) to contain the ink flow and direct any non-developed ink to an ink outlet (108). A main electrode (110) and a developer roller are electrically charged to manipulate the ink particles. Additionally, the gap between the main electrode (110) and the developer roller (104) creates a channel through which the ink is conveyed by the viscous action of the rotating drum (104). The main electrode also supports the various parts of the device (100).

A squeegee roller (112) compacts the ink film on the developer roller and removes any non-developed ink to create a uniform film of ink on developer roller (104). The outer surface of the developer roller (104) is initially coated with a relatively thick layer of ink as it comes in contact with ink that is pumped into the device through the ink inlet (120). Due to the electrostatic field generated by the electrical potential between the main electrode (110) and the developer roller (104), the ink particles preferentially adhere to the developer roller (104), thereby creating a high solid content ink film on the surface of the developer roller (104). The squeegee roller (112) compacts this high solid content ink film and knocks down the non-developed lower solid content ink.

Droplets exiting the ink tray (106) can cause an ink developer device to fail in at least three ways: cross-contamination, print quality issues, and customer dissatisfaction. Cross-contamination occurs when droplets from one binary ink developer impact an adjacent binary ink developer and contaminate its ink supplies. Print quality issues occur when droplets reach the photo imaging plate and appear as print quality defects on the printed page. Additionally, droplets can build up deposits of sludge inside or outside of the device. Sludge deposits can limit the actual or perceived lifetime of the device. External splashes build up on the outside of the binary ink developer as an unsightly accumulation of sludge. This can impact the total customer experience and prompts users to prematurely replace the binary ink developer.

Other components of the device (100) may include: a cleaning roller (114) to clean the developer roller (104); a wiper blade (126) to scrape excess ink from the cleaning roller (114); a sponge roller (116) to clean excess ink from the wiper blade (126) and/or cleaning roller (114); and a squeezer roller (118) to wring excess ink out of the sponge roller (116). The sponge roller (116) may come in contact with the wiper blade (126) and/or the cleaning roller (114) to clean one or both of them. An ink inlet (120) introduces fresh or recycled ink to the binary ink developer (100). Additionally, the binary ink developer (100) contains an ink drain passage (124) to allow the drainage of excess ink from the upper area of the ink developer (100).

Figure 2:
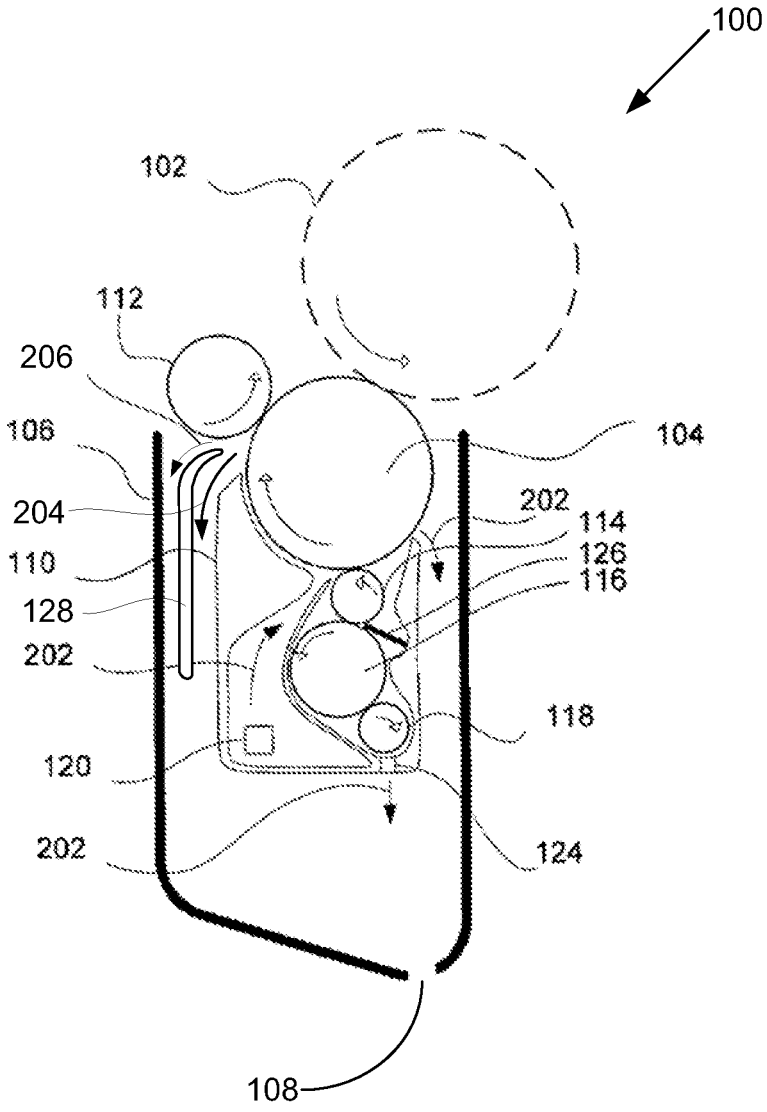
FIG. 2 shows the flow of ink in an ink developer device, according to principles described herein.

FIG. 2 illustrates an exemplary flow of ink in an ink developer device (100) according to one embodiment. As previously mentioned, the device (100) includes the ink developer roller (104), ink tray (106), ink outlet (108), main electrode (110), squeegee roller (112), cleaning roller (114), sponge roller (116), squeezer roller (118), ink inlet (120), ink drain passage (124), and wiper (126). The arrows inside each roller indicate the exemplary rotational direction of the respective roller. For example, several rollers (102, 112, 114, and 116) are shown to rotate in a counter-clockwise direction, whereas other rollers (104, 118) are shown to rotate in a clockwise direction.

As illustrated in FIG. 2 by the ink flow arrows (202), the device (100) receives fresh (or recycled) ink from the ink supply through the ink inlet (120). This ink travels upward and enters the channel between the main electrode (110) and the developer roller (104). The electrical potential bias between the main electrode (100) and the developer roller (104) causes ink particles to preferentially adhere to surface of the developer roller (104). The squeegee roller (112) regulates the ink film thickness on the developer roller (104). Ink is selectively transferred from the developer roller (104) to the charged portions of the photoconductive drum surface (102).

In one implementation, to provide printing performance and to optimize the ink circulation through the device with a minimum build up of sludge, the device (100) utilizes a variety of cleaning parts (such as 114, 116, and 118). The cleaning roller (114) removes leftover ink from the developer roller (104). The wiper blade (126) cleans the cleaning roller (114). The sponge roller (116) removes ink from the wiper blade (126) and/or cleaner roller (114). The squeezer roller (118) wrings the accumulated ink from the sponge roller (116).

As illustrated in FIG. 2, ink that is not transferred to the photo conductive drum returns via the ink outlet (108) to the ink reservoir to be reconditioned and re-circulated. There are three channels through which the ink can travel to reach the ink outlet (108). First, the excess ink that is wrung out of the sponge roller (116) by the squeezer roller (118) can exit the ink drain passage (124). Excess ink may also travel down the channels between the internal mechanisms and the front or rear walls of the ink tray (106). In particular, ink that is dislodged by the squeegee roller (112) passes between the main electrode (110) and the rear wall of the ink tray (106).

A splash guard (128) is used as a method to control splashes produced by the squeegee roller (112) as it compacts the ink film on the outer surface of the developer roller (104). The splash guard (128) can be attached to the main electrode (110) and/or the ink tray (106) by spacers that maintain the desired distance between the splash guard (128) and the surrounding components. The spacers create channels for the ink that is dislodged by the squeegee roller (112) to return to the bottom of the ink tray (106) and exit through the ink outlet (108).

The splash guard (128) is configured to split the flow of non-developed ink dislodged by the squeegee roller (112) into two separate streams. The majority of the ink (204) dislodged by the squeegee roller (112) is deflected downward by the splash guard (128) and passes between the main electrode (110) and the front surface of splash guard (128). A lesser, but still significant, portion of the ink (206) passes between the squeegee roller (112) and the outside splash guard surface. This second flow of ink (206) is sufficient to maintain a steady stream of ink down the back of the splash guard (128) and toward the ink outlet (108, FIG. 2), but does not typically fill the channel between the rear of the splash guard (128) and the housing (106).

Figure 3A:
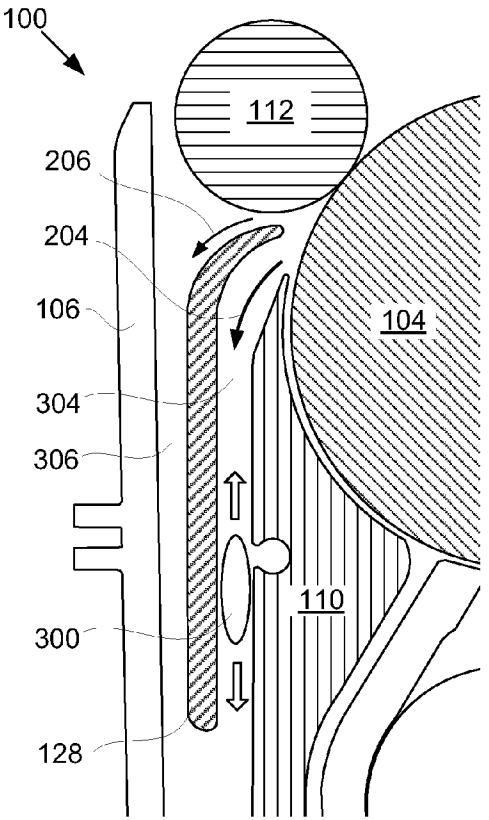
FIGS. 3A, 3B, and 3C show a time sequence in which a bubble bursts inside an ink developer device, creating ink droplets that are dispersed out of the ink developer device, according to principles described herein.
Figure 3B:
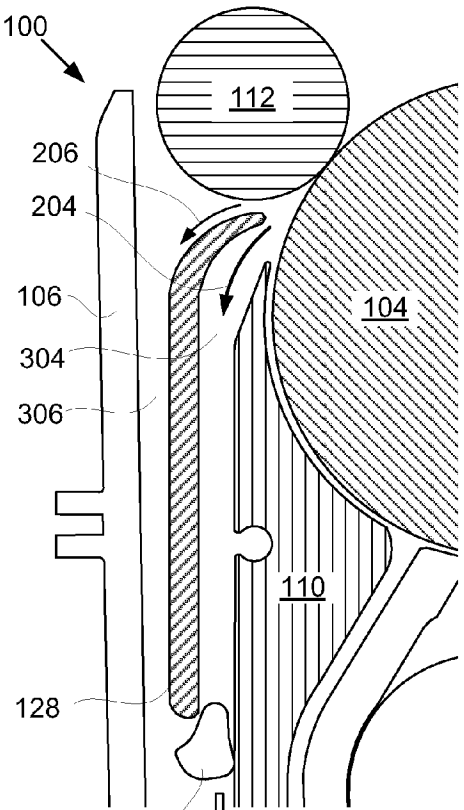
Figure 3C:
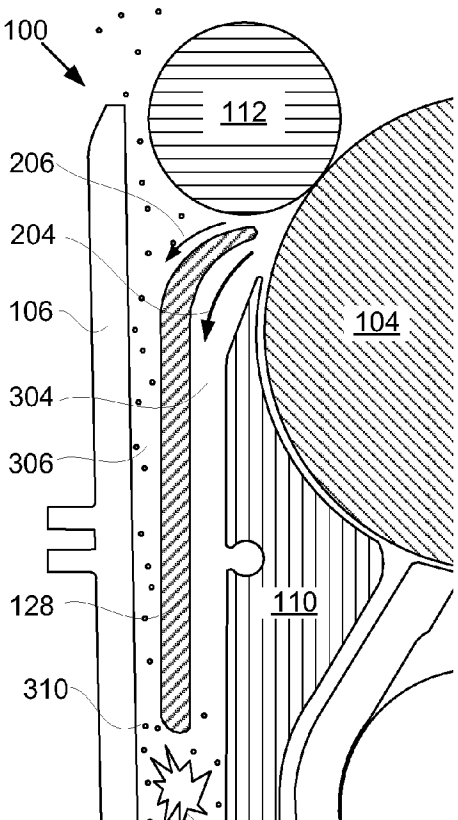

FIGS. 3A, 3B, and 3C show a time sequence in which a bubble (300) bursts inside an ink developer device (100) creating ink droplets (310) that are dispersed out of the ink developer device (100). FIG. 3A is a cross-sectional diagram of a portion of an ink developer device (100) showing the developer roller (104), ink tray (106), main electrode (110), squeegee roller (112), and a splash guard (128). As previously described, the ink dislodged by the squeegee roller (112) is split into two streams, a principal stream (204) which passes through the main channel and a secondary stream (206) which passes behind the splash guard (128).

Bubbles (300) can form in at least two different ways within the principal stream (204). In some circumstances, small bubbles may be entrained in the principal stream (204) as it enters the main channel between the splash guard (128) and the main electrode (110). These small bubbles coalesce into a larger bubble (300) which may remain trapped in the main channel for a period of time. In one embodiment, the fluid flow within the main channel is primarily turbulent in nature, which contributes to the entrainment of air into the ink flow (204). The second way that bubbles may enter the main channel is to enter from the bottom. In circumstances when the principal stream (204) does not substantially fill the main channel (304), air from the bottom of the main channel (304) may rise into the main channel (304) and become trapped by ink.

FIG. 3B shows the bubble (300) exiting the main channel. The bubble (300) may grow large enough to be pushed out of the main channel by fluid forces. As the bubble (300) exits the main channel, it is no longer surrounded by fluid or constraining walls.

FIG. 3C shows the bubble (300) bursting. The bubble (300) may burst for a variety of reasons including pressure differences between the main channel and the larger cross-sectional area of the ink tray (106). As the bubble (300) bursts, ink droplets (310) are ejected. These ink droplets (310) may exit out the secondary channel or through other routes to the surrounding area.

As the ink droplets (310) exit, they may contact various surfaces. A portion of the ink droplets (310) may adhere to a dry surface, such as the inner or outer surface of the ink tray (106). The carrier fluid in these droplets evaporates, leaving the ink particulates on the surface. Over time, these ink particulates accumulate and form sludge which can interfere with the proper operation of the ink developer. By way of example and not limitation, the ink droplets (310) may eventually fill the secondary channel (306) causing the secondary flow (206) to overflow and exit the ink tray. This overflow can cause a variety of problems including cross contamination, image defects, stains, and cause other customer quality issues.

Additionally, if the ink droplets contact the outside of ink tray, an unsightly accumulation of sludge may develop on the exterior of the ink tray (106) prompting the customer to prematurely replace the ink developer. Moreover, when an ink droplet (310) contacts a photo conductive drum (see e.g. 102, FIG. 1), it can be transferred to the printing medium and be manifest as a printing defect. In some cases, the ink droplets (310) may contact the printing medium itself.

Figure 4:
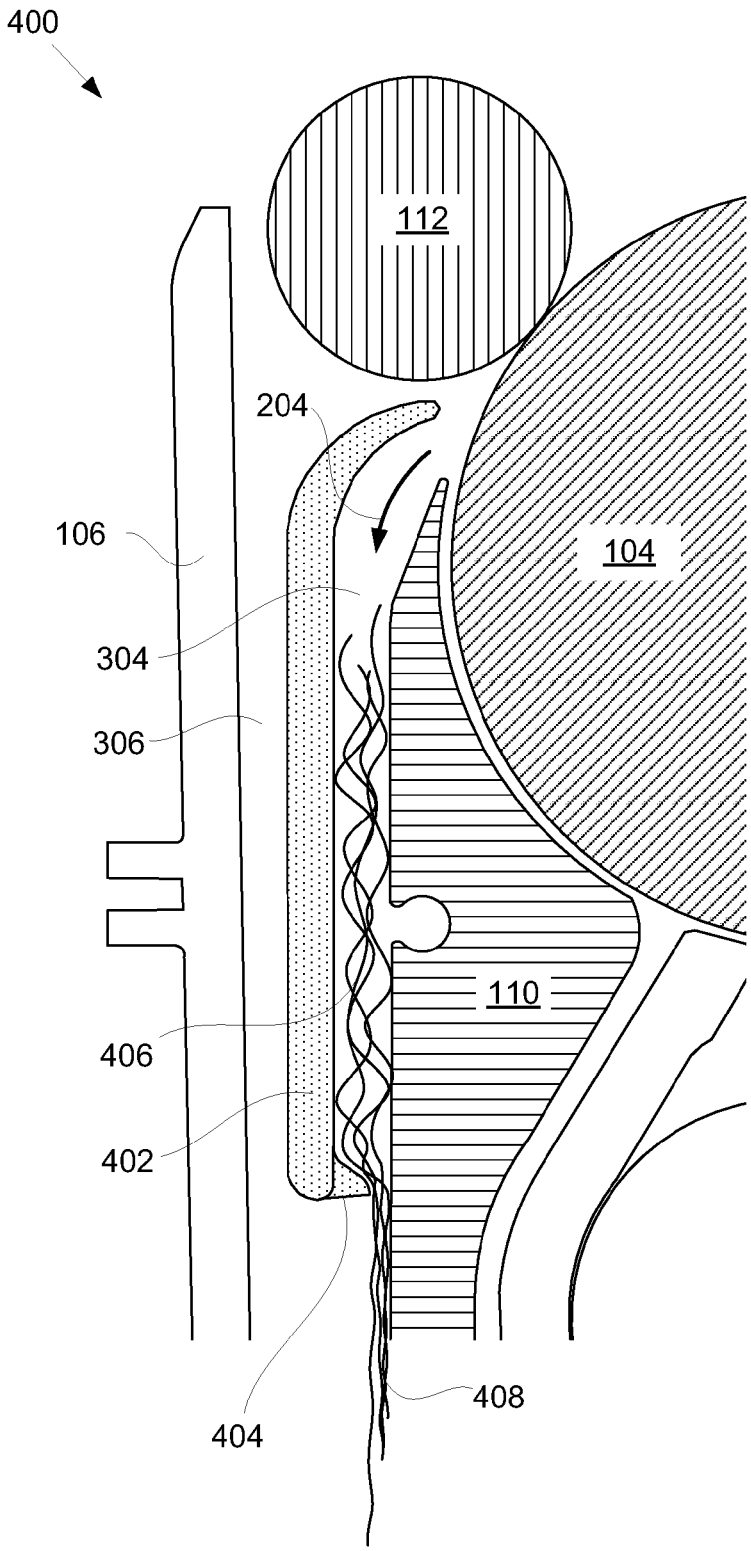
FIG. 4 is a cross-sectional diagram of an illustrative ink developer device containing an illustrative splash guard, according to principles described herein.

FIG. 4 shows a cross-sectional diagram of an illustrative ink developer device (400) which includes the ink developer roller (104), the squeegee roller (112), ink tray (106) and main electrode (110). The ink developer device (400) utilizes a splash guard (402) to prevent the formation and bursting of bubbles as described above. The splash guard (402) has a protrusion (404) along its bottom edge. The protrusion (404) shapes the principal ink flow (204) as it passes through the main channel (304). In some circumstances, the principal ink flow (204) may have a region of turbulent flow (406) as it passes through the main channel (304). The turbulent flow (406) region is characterized by increased stochastic property changes such as high momentum convection and variations of pressure and velocity in both space and time. This turbulent flow (406) normally exists throughout the main channel (304) and allows air bubbles to become trapped in the principal ink flow (204). In other cases, the principal ink flow (204) does not entirely fill the main channel (304). Air fills the balance of the main channel (304). This air is occasionally encircled by the principal ink flow (204) and swept out of the principal channel as an air bubble. As previously discussed, when these air bubbles eventually exit the main channel (304), the bubbles burst thereby dispersing ink droplets at relatively high velocities.

The protrusion (404) reduces the cross-sectional area of the main channel (304) and directs the principal ink flow (204) toward the main electrode wall as it exits from the main channel (304). This reduced cross-section in the principal ink flow can reduce the number of bubbles exiting and bursting in a number of ways. First, it is much more difficult for the air to enter the principal channel (304) through the channel's lower end because the flow restriction created by the protrusion (404) creates a fluid seal between the splash guard (402) and the electrode wall. Second, the protrusion (404) may prevent the bubbles which do become trapped in principal ink flow (204) from exiting. Third, the acceleration of the fluid as it passes through the constriction may lower the fluid pressure to more closely approximate that of the interior of the ink tray (106). If the pressure inside the bubble is approximately equal to the surrounding pressure, the bubble may burst much less energetically. Fourth, the protrusion (404) may force the bubbles to burst earlier in the fluid flow. In one illustrative embodiment, bubbles which burst as they are exiting through the flow constriction created by the protrusion (404) are much more benign.

In one exemplary embodiment, the protrusion (404) forces the principal ink flow (204) into contact with the main electrode (110). Surface tension forces tend to bind the principal ink flow (204) to the main electrode surface, resulting in a laminar flow region (408) as the principal ink flow (204) exits the main channel (304) and continues to travel downward. The laminar flow region (408) inhibits undesirable bubble bursting by allowing for an orderly escape of trapped air. Further, laminar flow reduces the introduction of additional air into the fluid flow, thereby reducing bubbles and foaming. In one exemplary embodiment, the air in the ink is separated from the ink as it passes through the reduced cross-section area produced by the protrusion (404). The principal ink flow (204) is adhered to the electrode wall and the air is allowed to escape into the interior of the ink tray (106).

Multiple ink developer devices may be utilized in a single printer. Each ink developer device may be in a different orientation within the printer. Therefore, the splash guard (402) and surrounding components should work throughout the normal range of orientations. Because the roller motion and surface tension are the principal drivers of the fluid flow within the ink developer, the fluid flow through the principal channel (304) and subsequent laminar flow (408) remain substantially unaffected by moderate changes in orientation of the ink developer device with respect to a downward gravity vector.

Figure 5:
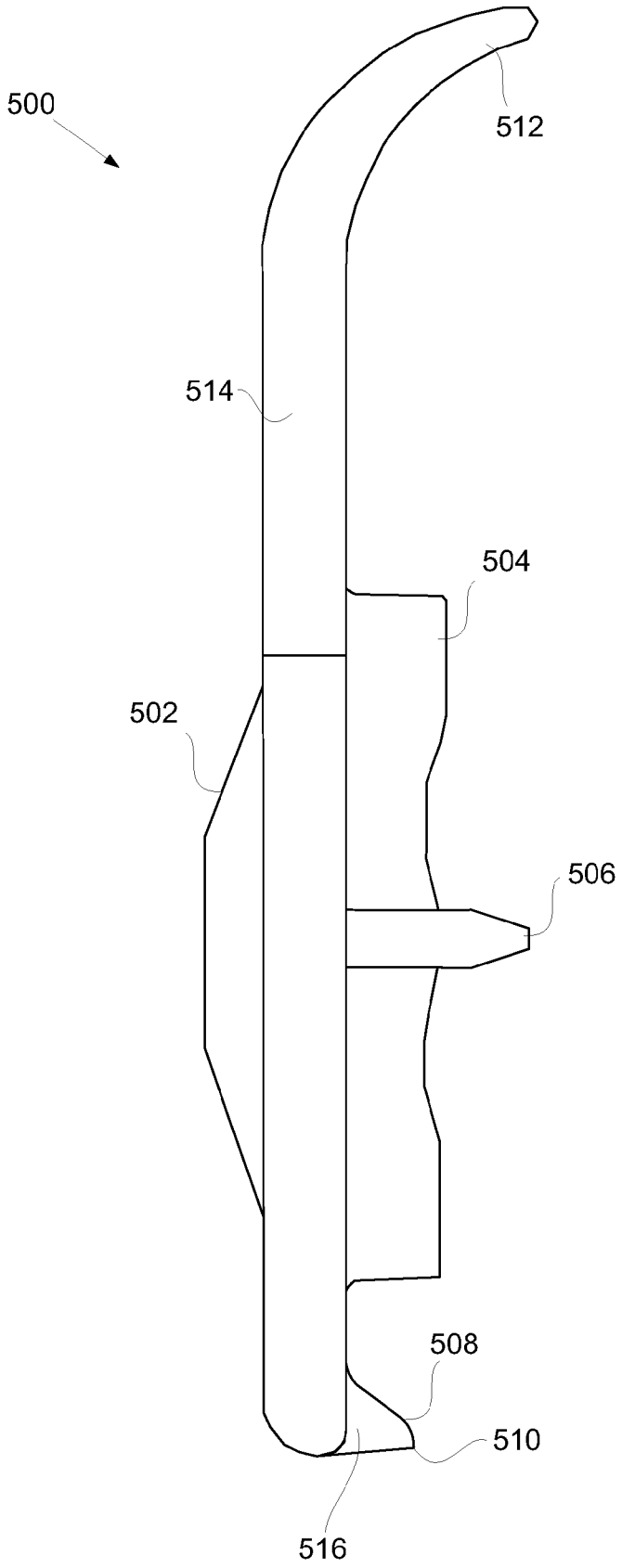
FIG. 5 is a side view of an illustrative splash guard, according to principles described herein.

FIG. 5 is a side view of one illustrative embodiment of a splash guard (500) for use in a binary ink developer. According to one exemplary embodiment, the splash guard (500) comprises a body portion (514) which terminates in an upper curved tip (512). The splash guard (500) may further comprise a secondary spacer (502) and a principal spacer (504). The spacers (502, 504) are configured to maintain the desired distances between the splash guard (500) and the surrounding components. For example, the principal spacer (504) may interface with the main electrode (110) to maintain the appropriate principal channel (304, FIG. 4) spacing.

The spacers (502, 504) may also incorporate alignment features. According to one exemplary embodiment, the principal spacer (504) may have a conical projection (506) designed to interface with a matching orifice in the main electrode (110). It will be appreciated by those of skill in the art that the projection (506) provides only one of many possible methods of aligning the splash guard (500).

The splash guard (500) may further comprise a protrusion (516) along its lower edge. The protrusion (516) may comprise a curved upper profile (508) that terminates in a sharp corner (510). According to one exemplary embodiment, the curved upper profile (508) is configured to direct the principal ink flow (204, FIG. 2) toward the electrode wall and the sharp corner (510) is configured to promote the separation of air out of the principal ink flow (204, FIG. 2).

Figure 6:
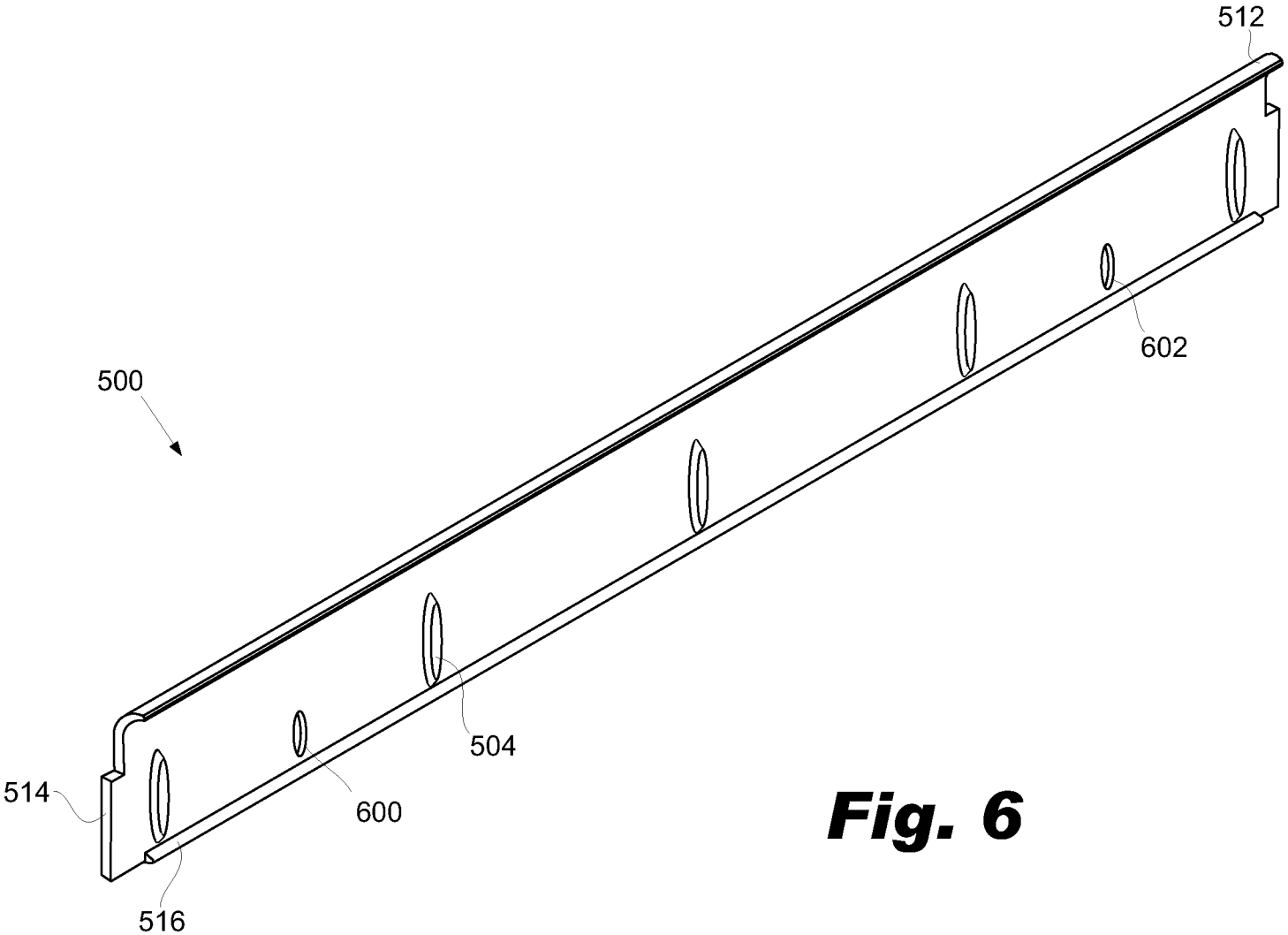
FIG. 6 is a perspective view of an illustrative splash guard, according to principles described herein.

FIG. 6 shows a perspective view of one exemplary embodiment of a splash guard (500). The body (514) of the splash guard (500) is substantially rectangular, with the top edge curving inward to form an upper curved tip (512). The protrusion (516) extends along at least a portion of the lower edge of the splash guard body (514). According to one exemplary embodiment, the protrusion (516) may not extend across portions of the lower edge at either end of the splash guard (500).

Principal spacers (504) are shown at even intervals along the side of the splash guard (500) and are designed to maintain the desired distance between the guard and the main electrode (110, FIG. 4). In this embodiment, the principal spacers (504) do not contain an alignment feature (506, FIG. 5). Instead, a number of elongated orifices (600, 602) in the splash guard body (514) are configured to receive fasteners, such as screws, that will hold the splash guard (500) in place.

A variety of methods could be used to precisely position the splash guard (500) with respect to the other components prior fixing the splash guard (500) in position using the fasteners. By way of example and not limitation, an alignment fixture could be inserted between the splash guard (500) and the rollers (104, 112) to precisely define the position of the splash guard tip (512) and the bottom protrusion (516). The fasteners could then be tightened to fix the splash guard (500) in position. Following the tightening of the fasteners, the fixture is removed.

In sum, a splash guard with a protrusion along the lower edge prevents large air bubbles from entering the principal channel. The protrusion smoothes the flow exiting from the principal channel and pushes it towards the main electrode. By preventing the undesirable entry of air and altering the flow of ink, the protrusion reduces stray ink droplets generated by bubbles bursting as they exit the principal channel. This reduces the risk of print quality defects, cross contamination, sludge build up, and messy leaks that that can cause customers to prematurely replace the ink developer device. The splash guard is a low cost solution that can be implemented as a single part, with no substantial modification of existing components.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. An apparatus for reducing ink droplets comprising:

a surface directing an ink flow into a channel; and a protrusion within said channel, in which said protrusion comprises a trailing edge to extract bubbles entrained in said ink flow and to break surface tension between said ink flow and said protrusion such that said ink flow adheres to a wall of said channel by surface tension, said ink flow exiting said channel in a laminar flow.

2. The apparatus of claim 1, wherein said surface directing said ink flow into a channel comprises a splash guard, said splash guard being mounted to a base.

3. The apparatus of claim 2, wherein said splash guard comprises a body portion, said body portion comprising a first wall of said channel and said base comprising a second wall of said channel.

4. The apparatus of claim 3, wherein said splash guard further comprises said protrusion, said protrusion extending along a lower edge of said body portion, said protrusion creating a reduced cross-section region within said channel.

5. The apparatus of claim 4, wherein said protrusion comprises a curved upper surface, said curved upper surface directing said ink flow into said reduced cross-section region.

6. The apparatus of claim 5, wherein said ink flow passing through said reduced cross-section region creates a fluid seal which reduces egress of air through said reduce cross-section region.

7. The apparatus of claim 1, in which said protrusion is positioned relative to a base such that an interior pressure of said bubbles is equalized with an ambient pressure at an exit of said channel.

8. An apparatus for reducing ink droplets generated by bursting bubbles within an ink developer comprising:

a splash guard configured to direct an ink flow into a channel, said splash guard being mounted to a support, said channel being formed by a space between said splash guard and said support;

a protrusion extending across a substantial portion of a lower edge of said splash guard, said protrusion creating a reduced cross-section area within said channel and breaking surface tension between an ink flow and said protrusion such that said ink flow adheres to said support by surface tension, said ink flow exiting said channel in a laminar flow.

9. The apparatus of claim 8, wherein said protrusion comprises a curved upper surface and a trailing edge, said curved upper surface directing said ink flow into said reduced cross-section region, wherein said ink flow passing through said reduced cross-section region creates a fluid seal which reduces egress of air through said reduce cross-section region such that bubbles in said ink flow are reduced, said trailing edge facilitating extraction of said bubbles entrained in said non-developed ink flow, said trailing edge further breaking surface tension between said non-developed ink flow and said protrusion such that said non-developed fluid flow tends adhere to said support by surface tension, said non-developed fluid flow exiting said channel in a substantially laminar flow.

10. An ink developer comprising:

an ink source supplying ink to said ink developer;

an electrode;

a developer roller, said electrode being configured to develop a portion of said ink onto said developer roller;

a splash guard, said splash guard being configured to direct an undeveloped ink flow into a channel located between said electrode and said splash guard, said channel having a reduced cross-section area; said reduced cross-section area being configured to reduce bubbles exiting said channel and bursting, in which the reduced cross section breaks surface tension between said ink flow and said reduced cross such that said ink flow adheres to the electrode by surface tension, said ink flow exiting said channel in a laminar flow.

11. The ink developer of claim 10, wherein said undeveloped ink flow passes through said reduced cross-section area of said channel, thereby creating a fluid seal which prevents air from passing through said fluid seal into said channel.

12. The ink developer of claim 10, wherein said splash guard further comprises a protrusion having a corner, said corner being configured to separate entrained air from said undeveloped ink flow.

13. An apparatus for extracting bubbles in an ink flow comprising:

a surface to direct an ink flow into a channel, said channel being formed by a space between said surface and a support; and a protrusion extending across a substantial portion of a lower edge of said surface, said protrusion creating a reduced cross-section area within said channel, in which the protrusion comprises a trailing edge to extract said bubbles in said ink flow and to break surface tension between said ink flow and said protrusion such that said ink flow adheres to said support by surface tension, said ink flow exiting said channel in a laminar flow.

14. The apparatus of claim 13, wherein said protrusion further comprises a curved upper surface, said curved upper surface directing said ink flow into said reduced cross-section region, wherein said ink flow passing through said reduced cross-section region creates a fluid seal which reduces egress of air through said reduce cross-section region such that bubbles in said ink flow are reduced.

* * * * *